US005871377A

United States Patent [19]

Sato et al.

[11] Patent Number: 5,871,377

[45] Date of Patent: Feb. 16, 1999

[54] LAMP SOCKET

[75] Inventors: Kensaku Sato; Tetsuya Takahashi, both of Tokyo, Japan

[73] Assignee: Hirose Electric Co., Ltd., Tokyo, Japan

[21] Appl. No.: 528,498

[22] Filed: Sep. 14, 1995

[30] Foreign Application Priority Data

Sep. 27, 1994 [JP] Japan ..... 6-256140

[51] Int. Cl.[6] ..... H01R 17/04

[52] U.S. Cl. ..... 439/675; 439/611; 439/918

[58] Field of Search ..... 439/340, 611, 439/613, 617–619, 672, 675, 763, 918

[56] References Cited

U.S. PATENT DOCUMENTS 2,883,520 4/1959 Sasseron ..... 439/611 X
2,988,725 6/1961 Vallee ..... 439/918 X
4,804,343 2/1989 Reedy ..... 439/918 X
5,087,213 2/1992 Drapcho et al. ..... 439/918 X
5,173,062 12/1992 Uchida ..... 439/918 X

*Primary Examiner*—Khiem Nguyen
*Attorney, Agent, or Firm*—Kanesaka & Takeuchi

[57] ABSTRACT

The press-fit section 31 is made up of a lance member 33 for engagement with the latch apertures 26*a* and 29*b* of terminal legs 26 and 29 of central and peripheral terminals 3 and 4 and a press-fit portion 36 formed by a pair of linear protrusions 34L and 34R and a pair of pressdown pieces 35L and 35R so that by engaging the lance member 33 with the latch apertures 26*a* and 29*b* and holding the terminal legs 26 and 29 between the pressdown pieces 35L and 35R and the linear protrusions 34L and 34R, the terminal leges 26 and 29 are connected to the press-fit terminal 5 with the crimping section 30 crimped on an electrical wire 39.

2 Claims, 7 Drawing Sheets

FIG. 1 (1)
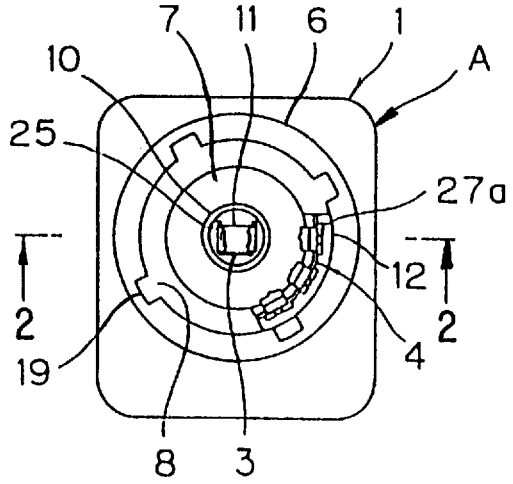
FIG. 1 (2)
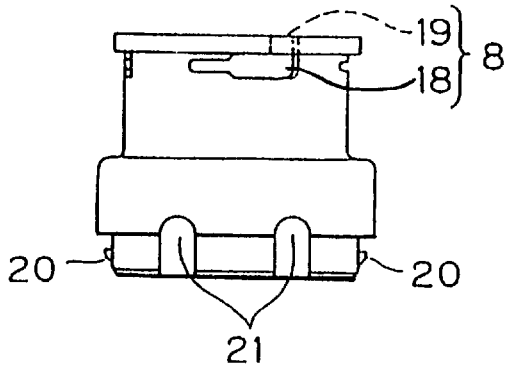
FIG. 1 (3)
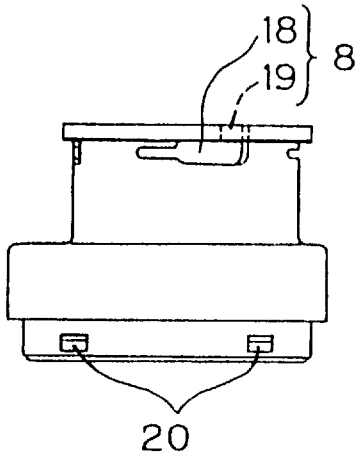
FIG. 1 (4)
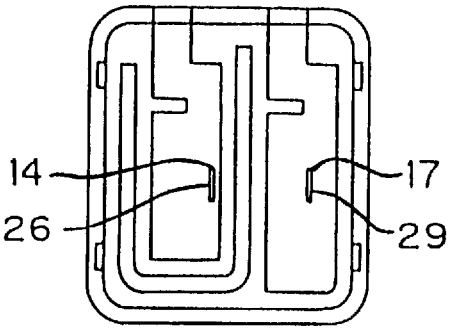

FIG. 3 (1)
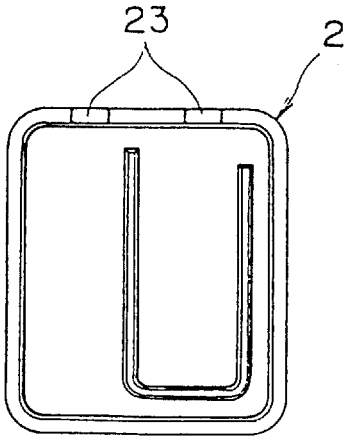
FIG. 3 (2)
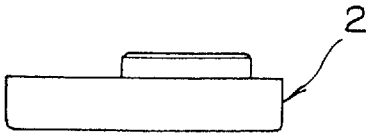
FIG. 3 (3)
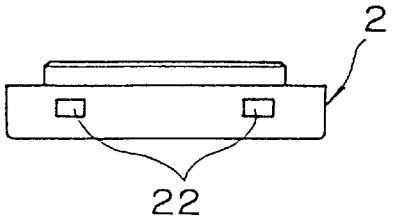
FIG. 3 (4)
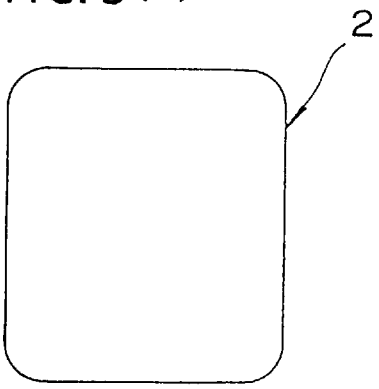

FIG. 4 (1)
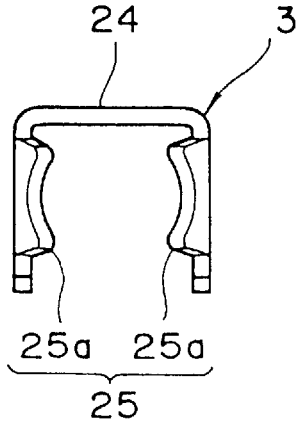
FIG. 4 (2)
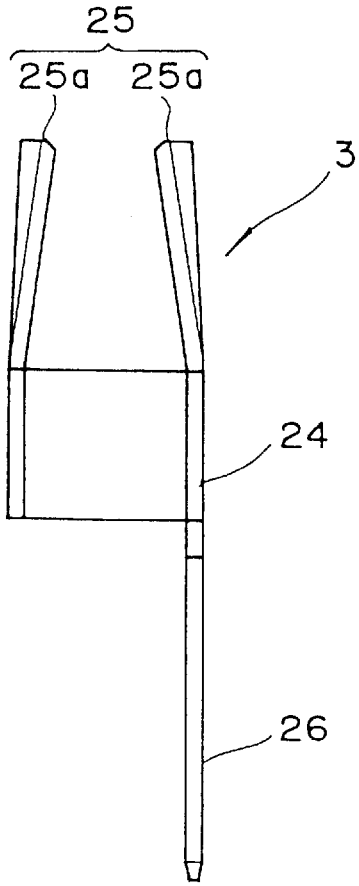
FIG. 4 (3)
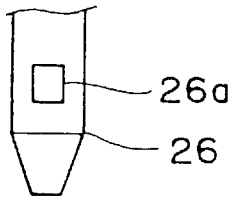

FIG. 5 (1)
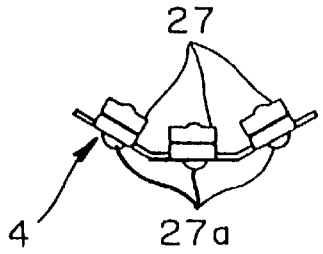
FIG. 5 (2)
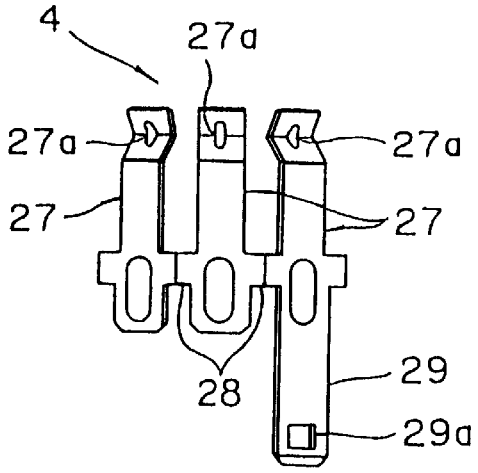
FIG. 5 (3)
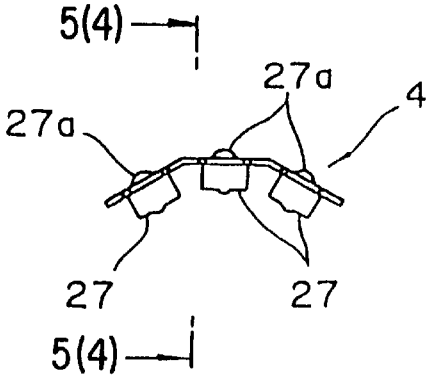
FIG. 5 (4)
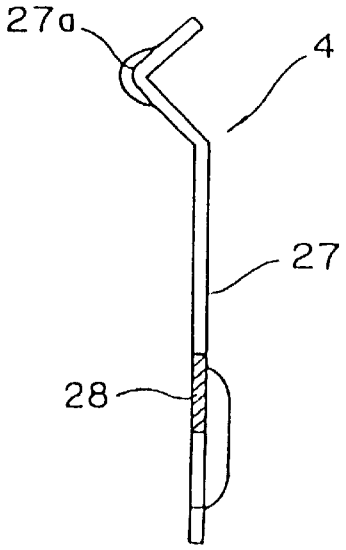

FIG. 6 (1)
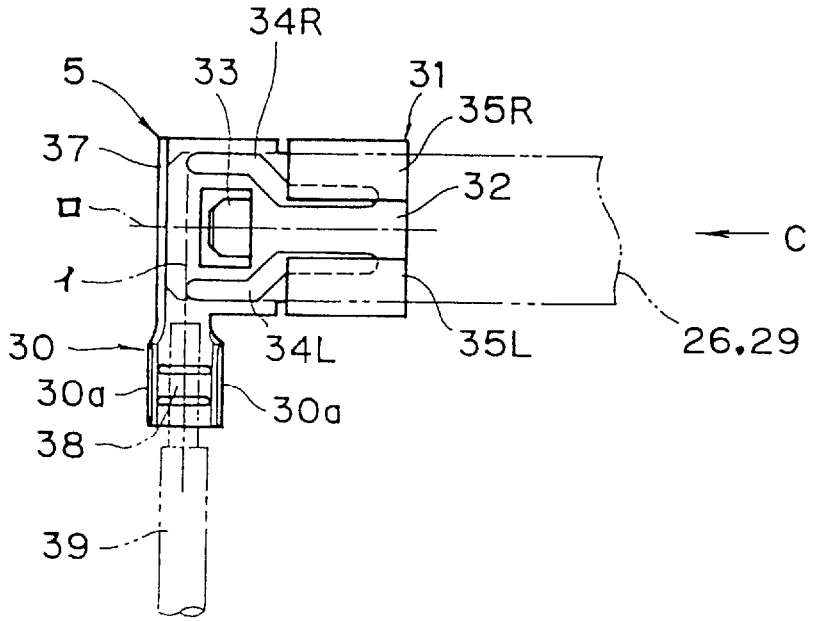
FIG. 6 (2)
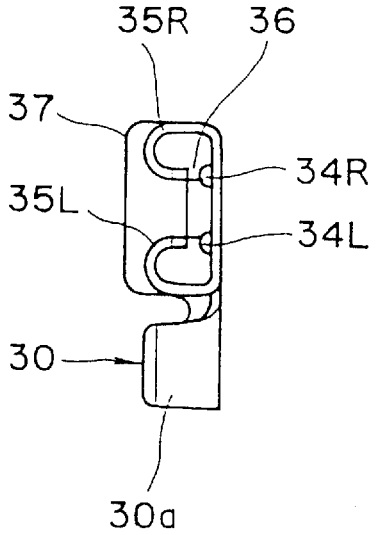

FIG. 7 (1)
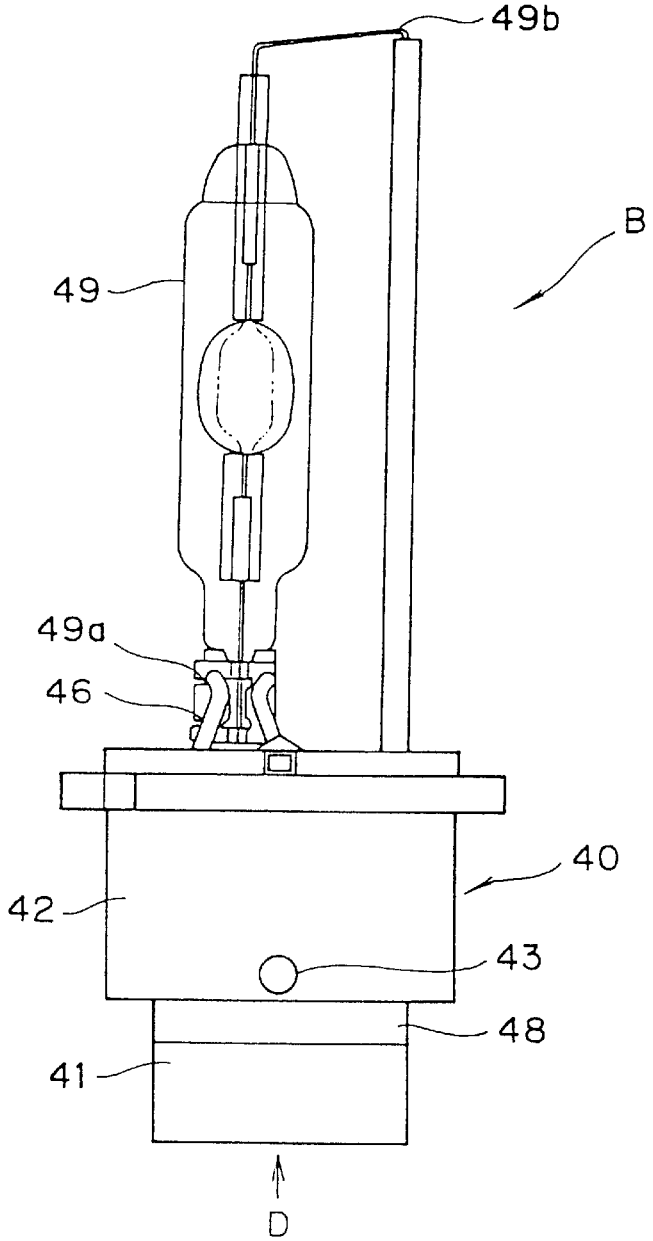
FIG. 7 (2)
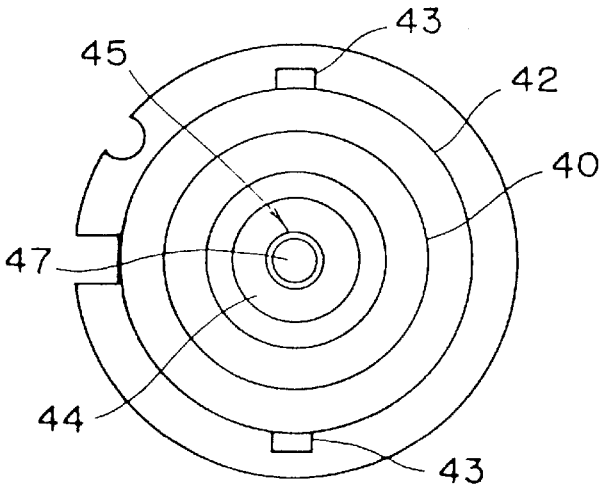

LAMP SOCKET

BACKGROUND OF THE INVENTION

1. Field of the Invention

The present invention relates to lamp sockets on which lamps, such as automobile headlights, are mounted.

2. Description of the Prior Art

Recently, lamps, such as automobile headlights, which are as bright as daylight, have been developed. Such lamps require that the voltage must rise to high potentials instantly. In order to meet such a requirement, it has been practiced to weld electrical wires to the lamp terminals of lamp sockets for the lamps.

However, such welding requires welding equipment and welding operations, resulting in the high manufacturing costs.

SUMMARY OF THE INVENTION

Accordingly, it is an object of the invention to provide a lamp socket which requires neither welding equipment nor welding operations but increases the productivity and decreases the manufacturing costs.

According to the invention there is provided a lamp socket which includes a socket body having a fitting cavity and first and second terminal outlet cavities provided behind the fitting cavity; a central terminal provided at a center of the fitting cavity and a first terminal leg projecting into the first terminal outlet cavity; a peripheral terminal provided along a circumferential surface of the fitting cavity and having a second terminal leg projecting into the second terminal outlet cavity; and a press-fit connection terminal for connecting an electrical wire to one of the first and second terminal legs.

It is preferred that the connection terminal includes a crimping section to be crimped on an electric wire and a press-fit section to be press fitted over one of the first and second terminal legs.

It is also preferred that the press-fit section comprises a lance member for engagement with one of the first and second terminal legs and a press-fit portion made up of a pair of linear protrusions and a pair of pressdown pieces into which one of the first and second terminal legs is press fitted.

The connection terminal connects an electrical wires to the first and second terminal legs of the central and peripheral terminals. That is, by engaging the lance member with the terminal legs while holding the terminal legs between the linear protrusions and the pressdown pieces, and press fitting the connection terminal over the terminal legs it is possible to connect the electrical wires to the lamp socket without the use of welding.

The above and other objects, features, and advantages of the invention will be more apparent from the following description when taken in conjunction with the accompanying drawings.

BRIEF DESCRIPTION OF THE DRAWINGS

FIG. 1(1) is a top view of a lamp socket with out a cover according to an embodiment of the invention;

FIG. 1(2) is a front view of the lamp socket;

FIG. 1(3) is a side view of the lamp socket;

FIG. 1(4) is a bottom view of the lamp socket;

FIG. 3(1) is a top view of the cover for the lamp socket;

FIG. 3(2) is a front view of the cover;

FIG. 3(3) is a side view of the cover;

FIG. 3(4) is a bottom view of the cover;

FIG. 4(1) is a top view of a central terminal;

FIG. 4(2) is a front view of the central terminal;

FIG. 4(3) is a front view of part of a central terminal leg of the terminal;

FIG. 5(1) is a top view of a peripheral terminal;

FIG. 5(2) is a front view of the peripheral terminal;

FIG. 5(3) is a bottom view of the peripheral terminal;

FIG. 5(4) is a sectional view taken along line B—B of FIG. 5(3);

FIG. 6(1) is a top view of a connection terminal;

FIG. 6(2) is a side view as viewed from arrow C;

FIG. 7(1) is a front view of a lamp; and

FIG. 7(2) is a bottom view as viewed from arrow D.

DESCRIPTION OF THE PREFERRED EMBODIMENT

Figure 2:
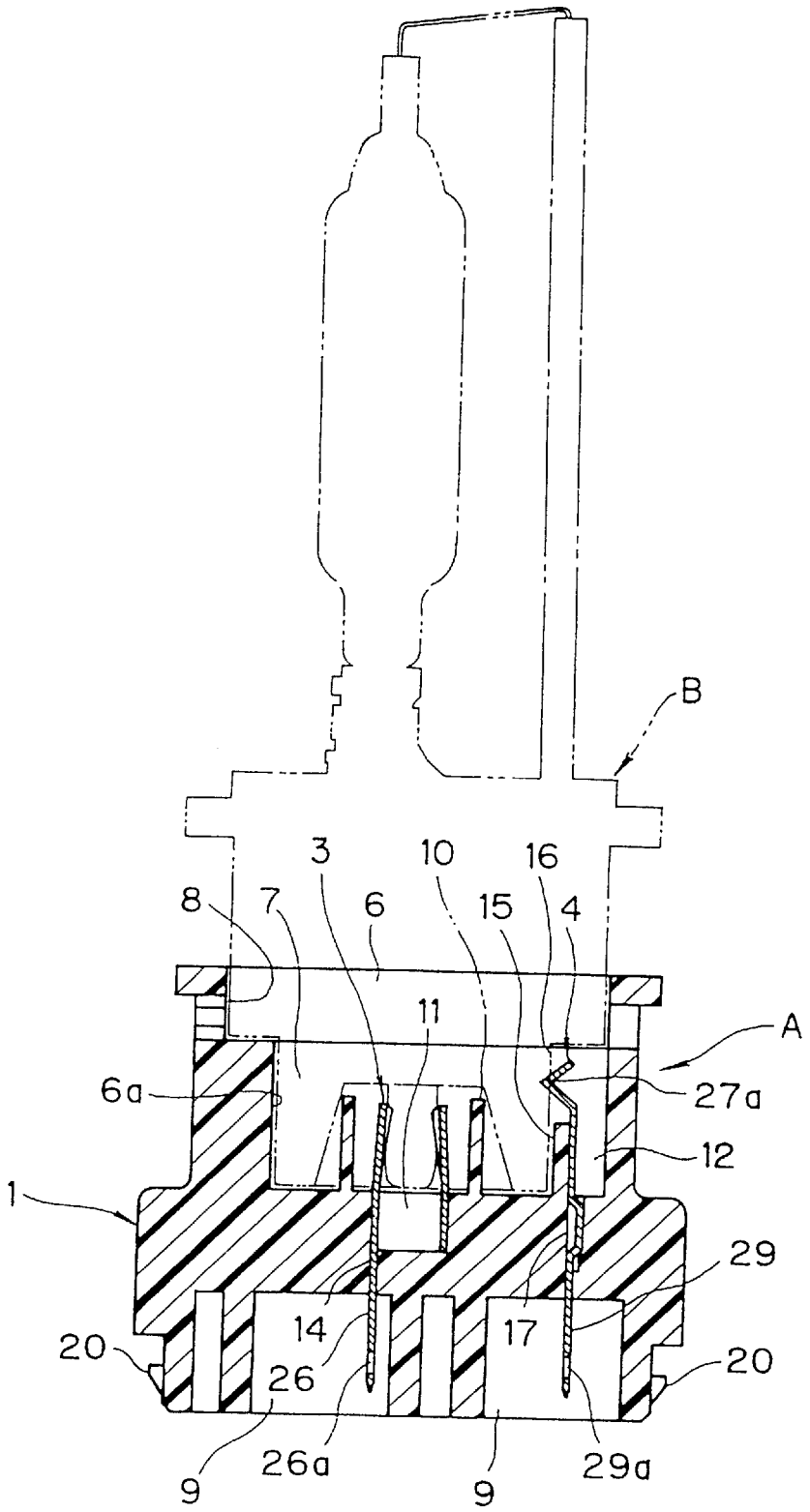
FIG. 2 is a sectional view taken along line A—A of FIG. 1(1)

An embodiment of the invention will now be described below with reference to the accompanying drawings.

FIG. 1(1) is a top view of a lamp socket without a cover according to an embodiment of the invention; FIG. 1(2) is a front view of the lamp socket; FIG. 1(3) is a side view of the lamp socket; FIG. 1(4) is a bottom view of the lamp socket; and FIG. 2 is a sectional view taken along line A—A of FIG. 1(1).

The lamp socket A includes a socket body 1, a cover 2, a central terminal 3 and a peripheral terminal 4, and a connection terminal 5.

In FIGS. 1 and 2, the socket body 1 has a circular recess 6 with a fitting cavity 7 and a lamp latch 8 and a terminal outlet cavities 9 behind the fitting cavity 7. The fitting cavity 7 has an annular shaped bottom between the central cylinder 10 and the inner surface 6*a* of the circular recess 6. Terminal mounts 11 and 12 are provided on the bottom of the central cylinder 10 and the circumferential surface of the fitting cavity 7, respectively.

The central terminal mount 11 has a terminal aperture 14 communicating with the terminal outlet cavity 9. The peripheral terminal mount 12 is separated from the fitting cavity 7 by a partition wall 15 which defines an upper opening through which the peripheral terminal 4 is exposed. The peripheral terminal mount 12 has a terminal aperture 17 communicating with the terminal outlet 9.

The lamp latch 8 is made up of a plurality of latch apertures 18 provided in the circumferential wall of the circular recess 6 at regular intervals and insertion grooves 19 provided on the inner surface of the circular recess 6 and communicating with the latch apertures 18. A plurality of latch projections 20 and a plurality of wire outlet openings 21 are provided on and in the lower circumferential wall of the socket body 1, respectively. As shown in FIG. 3, latch projections 22 and wire outlet openings 23 are provided on and in the cover 2, respectively.

In FIG. 4, the central terminal 3 has a C-shaped press-fit section 24, a lamp contact section 25 having a pair of opposed contact pieces 25*a*, and a terminal leg 26 having a latch aperture 26*a*.

In FIG. 5, the peripheral terminal 4 has three terminal sections 27 connected by linking portions 28 and each having a contact points 27*a* and a terminal leg 29 having a latch aperture 29*a*.

In FIG. 6, the connection terminal 5 has a wire crimping section 30 having a pair of crimping tabs 30*a* and a press-fit section 31 extending at right angles with an axis ( ) of the crimping section 30. The press-fit section 31 has a base portion 32 provided with a lance member 33, left and right linear protrusions 34L and 34R symmetrically provided with respect to an axis (□) of the base portion 32, and left and right pressdown pieces 35L and 35R extending first upwardly from the base portion 32 and then downwardly to the ridges 34L and 34R to form press-fit portions 36. A stopper section 37 extends upwardly from the base 32 on the side opposite to the press-fit portion 36.

The central terminal 3 is press fitted into the terminal mount 11 of the socket body 1 such that the terminal leg 26 projects into the terminal outlet cavity 9 while the peripheral terminal 4 is press fitted into the terminal mount 12 such that the contact points 27*a* are exposed in the fitting cavity 7 through the upper opening 16 and the terminal leg 29 projects into the terminal outlet cavity 9 through the terminal aperture 17.

The connection terminals 5 are fitted over the terminal legs 26 and 29 of the central and peripheral terminals 3 and 4, respectively, until the stopper wall 37 abuts against the terminal legs 26 and 27 so that the lance members 33 engage the latch apertures 26*a* and 29*a* of the terminal legs 26 and 29 while the terminal legs 26 and 29 are held between the pressdown pieces 35L and 35R and the linear protrusions 34L and 34R. The crimping tabs 30*a* of the connection terminal 5 are crimped on the core wire 38 to secure the electrical wire 39 (see FIG. 6).

The cover 2 is mounted on the socket body 1 by engaging the latch projections 20 with the latch apertures 22 such that the wire outlet openings 21 and 23 of the socket body 1 and the cover 2 are aligned to allow the electric wires 39 to go out through the wire outlet openings 21 and 23.

In FIG. 7, a lamp B has a lamp body 40 having a fitting section 41 to be fitted into the fitting cavity 7 of the socket A and a base portion 42 with latch pins 43 for engagement with the lamp latch 8. An annular recess 44 is provided on a bottom of the fitting section 41.

A lamp terminal 45 is mounted at the center of the lamp body 40 such that a lamp connection portion 46 is exposed above the top of the lamp body 40 while a contact portion 47 projects into the circular recess 44. A contact ring 48 is provided on the circumferential surface of the fitting section 41.

A bulb 49 is connected to the connection section 46 of the lamp terminal 45 such that a first contact 49*a* is connected to the lamp terminal 45 while a second contact 49*b* is connected to the contact ring 48.

The lamp B is mounted on the lamp socket A by fitting the fitting section 41 into the fitting cavity 7 of the socket A and putting the latch pins 43 into the guide grooves 19 and then rotating the lamp B to engage the latch pins 43 with the latch holes 18. As a result, the contact portions 47 and 48 of the lamp terminal 45 are brought into contact with the contact portions 25 of the central terminal 3 and peripheral terminal 4, respectively. respectively.

As has been described above, according to the invention, the terminal press-fit section 31 is made up of the lance member 33 for engagement with the latch apertures 26*a* and 29*b* of the terminal legs 26 and 29 and the pair of linear protrusions 34L and 34R and the pair of pressdown members 35L and 35R to form the pressdown portion so that by engaging the lance member 33 with the latch apertures 26*a* and 29*b* of the terminal legs 26 and 29 and putting the terminal legs 26 and 29 between the pressdown members 35L and 35R and the linear protrusions 34L and 34R it is possible to connect the terminals 3 and 4 to the section terminal 5. The crimping section 30 is crimped on the electrical wire 39 to provide firm connection. Thus, it is not necessary to weld the electrical wire 39 to the terminals legs 26 and 29, resulting in the increased productivity and the reduced production costs.

As has been described above, the central and peripheral terminals are provided at the center and the periphery of the fitting recess of the socket body while the terminals legs are connected to the electrical wire via the connection terminal, thus eliminating the need for welding the electrical wire to the terminal legs. As a result, the welding equipment and operations are eliminated, resulting the increased productivity and the reduced production costs.

The connection terminal has the wire crimping section and the press-fit section for press-fit over one of the terminal legs so that the crimping section is crimped on the electrical wire, and the press-fit section is press fitted over either of the terminal legs.

The connection terminal is made up of the lance member for engagement with the latch aperture of one of the terminal legs and the press-fit section for press-fit over one of the terminal legs so that by engaging the lance member with the latch aperture of one of the terminal legs and press fitting the connection terminal over one of the terminal legs, and crimping the electrical wire to the connection terminal, it is possible to provide firm connection without the use of welding.

What is claimed is:

1. A lamp socket comprising:

a socket body having a fitting cavity and first and second terminal outlet cavities provided behind said fitting cavity;

a central terminal provided at a center of said fitting cavity and having a first terminal leg projecting into said first terminal outlet cavity and having an aperture in said first terminal leg;

a peripheral terminal provided along a circumferential surface of said fitting cavity and having a second terminal leg projecting into said second terminal outlet cavity and having an aperture in said second terminal leg;

a press-fit connection terminal for connecting an electrical wire to one of said first and second terminal legs, said press-fit connection terminal comprising:

a crimping section to be crimped on an electric wire;

a press-fit section to be press fitted over one of said first and second terminal legs;

a lance member for engagement with said aperture of one of said first and second terminal legs.

2. A lamp socket according to claim 1, wherein said press-fit section comprises a pair of linear protrusions and a pair of pressdown pieces into which one of said first and second terminal legs is press fitted.

* * * * *